US006244250B1

(12) United States Patent
Hlousek

(10) Patent No.: US 6,244,250 B1
(45) Date of Patent: Jun. 12, 2001

(54) COMMON RAIL INJECTOR

(75) Inventor: Jaroslaw Hlousek, Golling (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/561,909

(22) Filed: May 1, 2000

(51) Int. Cl.[7] ..... F02M 37/04
(52) U.S. Cl. ..... 123/467; 123/446
(58) Field of Search ..... 123/467, 446, 123/458, 506, 500, 501

(56) References Cited

U.S. PATENT DOCUMENTS 4,437,443 * 3/1984 Hofbauer ..... 123/446
4,545,352 * 10/1985 Jourde et al. ..... 123/447
4,784,101 * 11/1988 Iwanaga et al. ..... 123/446
5,176,120 * 1/1993 Takahashi ..... 123/467
5,341,783 * 8/1994 Beck et al. ..... 123/446
5,477,834 * 12/1995 Yoshizu ..... 123/501
5,915,361 * 6/1999 Heinz et al. ..... 123/467

* cited by examiner

*Primary Examiner*—Carl S. Miller
(74) *Attorney, Agent, or Firm*—Ronald E. Greigg; Edwin E. Greigg

(57) ABSTRACT

A common rail injector having an injector housing that can be made to communicate via a high-pressure connection with a high-pressure reservoir. A nozzle needle is axially displaceable against a nozzle needle seat in order to adjust the injection onset and the injection quantity in a common rail injection system of an internal combustion engine as a function of the position of a magnet-controlled control piston that is prestressed counter to a spring. To make it possible that during operation to characterize the opening and closing operation of the nozzle needle, the nozzle needle is coupled via an intermediate piece to a servo piston that cooperates with the control piston.

5 Claims, 1 Drawing Sheet

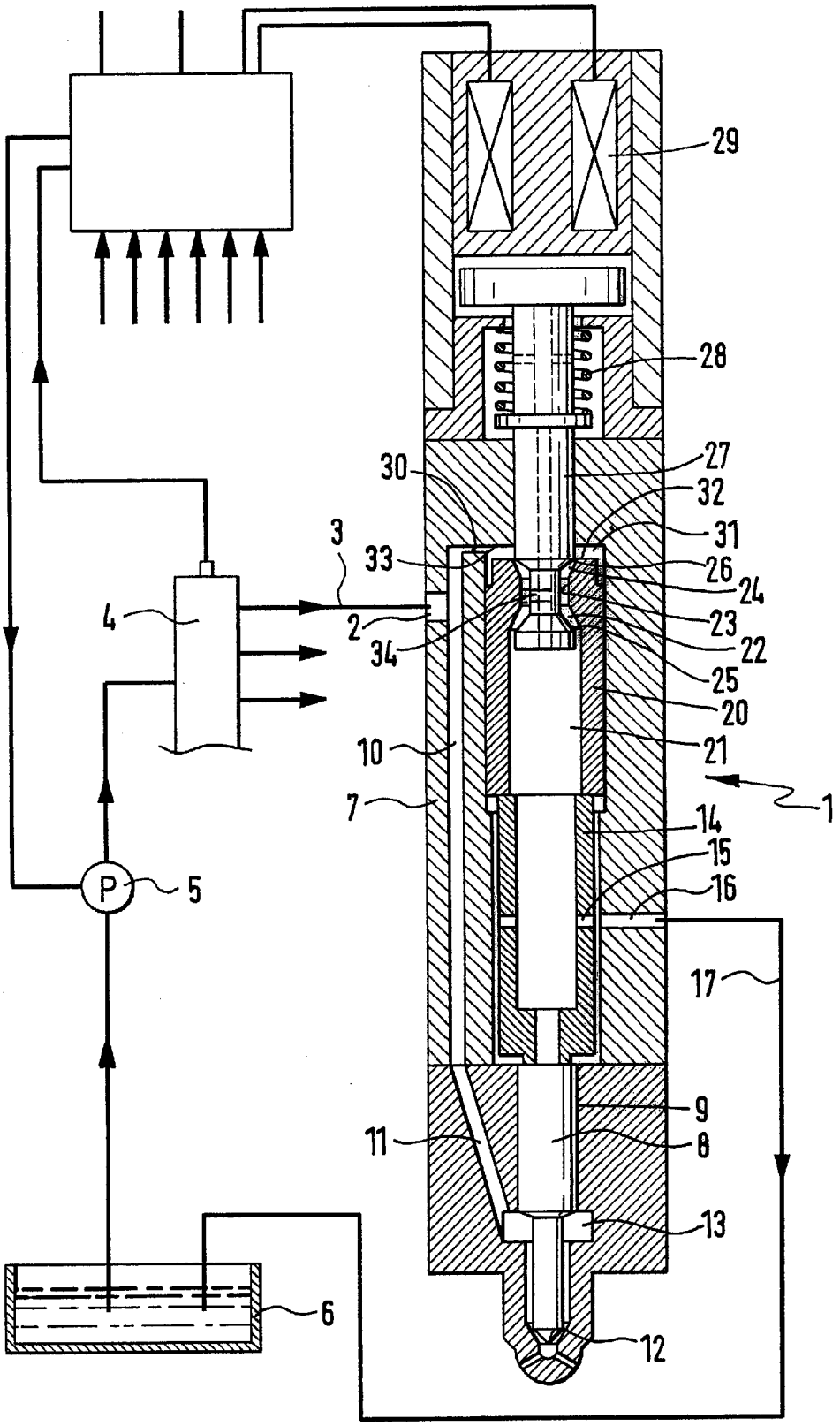
29
28
27
30
32
31
3
33
26
24
4
2
23
34
22
25
20
10
21
1
7
14
15
P
5
16
17
9
11
8
13
6
12

COMMON RAIL INJECTOR

FIELD OF THE INVENTION

The invention is relates to a common rail injector having an injector housing that can be made to communicate via a high-pressure connection with a high-pressure reservoir. The nozzle needle is axially displaceable against a nozzle needle seat in order to adjust the injection onset and the injection quantity in a common rail injection system of an internal combustion engine as a function of the position of a magnet-controlled control piston that is prestressed counter to a spring.

BACKGROUND OF THE INVENTION

In conventional common rail injectors, it is true that the opening point and possibly the closing point of the magnet valve can be characterized by means of control current analysis, but the motion of the nozzle needle cannot. Functional monitoring of the injectors is possibly only at additional expense, for example with the needle stroke sensors.

OBJECT AND SUMMARY OF THE INVENTION

An object of the invention is to furnish a common rail injector of the type described at the outset in which the opening and/or closing operation of the nozzle needle is detectable in operation.

In a common rail injector having an injector housing that can be made to communicate via a high-pressure connection with a high-pressure reservoir and in which a nozzle needle is axially displaceable against a nozzle needle seat in order to adjust the injection onset and the injection quantity in a common rail injection system of an internal combustion engine. As a function of the position of a magnet-controlled control piston that is prestressed counter to a spring, this object is attained in that the nozzle needle is coupled via an intermediate piece to a servo piston that cooperates with the control piston. As a result, a direct communication between the nozzle needle and the servo piston is made possible. The injection onset for each injector can thus be associated with top dead center. A functional diagnosis of the injection event can be made at any time by means of control current analysis.

A particular embodiment of the invention is characterized in that between the high-pressure connection and a control chamber, a first throttle is provided, whose diameter is less than the diameter of a second throttle that is provided between the control chamber and a pressureless chamber in the interior of the servo piston. A first control piston seat and a second control piston seat, which are spaced apart from one another, are formed on the control piston between the control chamber and the pressureless chamber. The two seats on the control piston limit the stroke of the servo piston relative to the control piston. By means of the two throttles, it is attained that the pressure in the control chamber drops when there is flow through both throttles. This in turn means that the servo piston and the intermediate piece move into the control chamber, the effect of which is that the nozzle needle is lifted from its seat.

A further particular embodiment of the invention is characterized in that a stop for the servo piston is provided in the injector housing. By means of the stop, the motion of the servo piston in the opening direction of the nozzle needle is limited.

A further particular feature of the invention is characterized in that the end face, protruding into the control chamber, of the servo piston is larger than the face of the nozzle needle acted upon by pressure. This assures that the nozzle needle is pressed against the nozzle needle seat if the same pressure prevails in the control chamber and at the nozzle needle, and if there is no current through the magnet that actuates the control piston.

Further advantages, characteristics and details of the invention will become apparent from the ensuing description, in which an exemplary embodiment of the invention is described in detail in conjunction with the drawing. The characteristics recited in the claims and in the description can be essential to the invention individually or in arbitrary combination.

The invention will be better understood and further objects and advantages thereof will become more apparent from the ensuing detailed description of a preferred embodiment taken in conjunction with the drawing.

BRIEF DESCRIPTION OF THE DRAWING

The sole drawing FIGURE shows a longitudinal section through a common rail injector with an injector housing.

DESCRIPTION OF THE PREFERRED EMBODIMENT

The drawing shows a longitudinal section through a common rail injector 1 with an injector housing 7. The injector housing 7 communicates with a high-pressure reservoir 4 via a high-pressure connection 2 and a high-pressure line 3. The high-pressure reservoir 4 is supplied with fuel from a fuel tank 6 via a pump unit 5.

A nozzle needle 8 with a nozzle needle diameter 9 is received axially displaceably in the injector housing 7. The tip of the nozzle needle 8 rests on a nozzle needle seat 12. In this state, the injector 1 is closed.

Via high-pressure bores 10 and 11 in the injector housing 7, the fuel, acted upon by high pressure, flows from the high-pressure connection 2 into a pressure chamber 13 in the region of the tip of the nozzle needle 8. The butt end of the nozzle needle 8 rests on an intermediate piece 14. Bores 15 are made in the intermediate piece 14, by way of which the fuel can flow out of the interior of the intermediate piece 14 back into the fuel tank 6, via a conduit 16 and a pressureless line 17.

A servo piston 20 rests on the end of the intermediate piece 14 remote from the nozzle needle 8. A pressureless chamber 21 is embodied in the interior of the servo piston 20 and communicates with the interior of the intermediate piece 14. A bore with different bore diameters is made on the end of the servo piston 20 remote from the intermediate piece 14. The pressureless chamber 21 has a constant internal diameter. It is adjoined by a tapering region 22. The tapering region 22 is followed by a region 23 of constant diameter; the internal diameter in the region 23 is less than the diameter in the pressureless chamber 21. The region 23 of constant internal diameter is followed by a region 24 of widening diameter.

On a control piston 27, a first control piston seat 25 and a control piston seat 26 are formed. The first control piston seat 25 cooperates with the widening region 24. The second control piston seat 26 cooperates with the tapering region 22. The control piston 27 is prestressed by a spring 28. As a result, it is attained that the control piston 27 presses the nozzle needle 8 against the nozzle needle seat 12, via the servo piston 20 and the intermediate piece 14. In the closed state of the injector 1, the nozzle needle 8 is coupled with the control piston 27 in such a way that the nozzle needle 8 rests on the intermediate piece 14, the intermediate piece 14 rests on the servo piston 20, and the servo piston 20 rests on the control piston 27.

Via a magnet 29, the control piston 27 can be moved toward the magnet 29 counter to the force of the spring 28. If that is the case, fuel flows from the high-pressure connection 2 through a first throttle 30 into a control chamber 31 and from there through a second throttle 34 into the pressureless chamber 21. The flow cross section of the second throttle 34 is greater than the flow cross section of the first throttle 31. As a result, it is attained that the pressure in the control chamber 31 decreases when the control piston seats 25 and 26 are opened, so that the fuel can flow out of the control chamber 31 through the second throttle 34 into the pressureless chamber 21. The decreasing pressure in the control chamber 31 causes the servo piston 20 to move toward a stop 33. Once the servo piston 20 rests with its end face 32 on the stop 33, the injector 1 is open.

Mode of Operation

The common rail injector of the invention functions as follows: The injector 1 communicates with the high-pressure reservoir 4 through a high-pressure line 3. The nozzle needle seat 12 and the end face 32 of the servo piston 20 are acted upon by the system pressure, through the bores 10, 11 and the throttle 30.

Without current to the magnet 29, the control piston 27 is pressed against the seat 26 by means of the spring 28. This seals off the outlet to the pressureless chamber 21. The end face 32, which is larger than the needle diameter 9, guarantees that the nozzle needle 8 is pressed against the seat 12.

The injection is effected by supplying current to the magnet 29. The control piston 27 is attracted, counter to the force of the spring 28. The seat 26 is opened, and after a short stroke (seat 25), the outlet to the pressureless chamber 21 is controlled by the throttle 34. The diameters of the seats 25, 26 and of the control piston 27 are all equal. The throttle 34 is larger than the throttle 30. Thus the pressure in the control chamber 31 drops, and the needle 8, intermediate piece 14 and servo piston 20 begin to move in the direction of the stop 33. The injection begins.

The opening point is detected by a control current analysis.

The foregoing relates to a preferred exemplary embodiment of the invention, it being understood that other variants and embodiments thereof are possible within the spirit and scope of the invention, the latter being defined by the appended claims.

I claim:

1. A common rail injector (1) comprising an injector housing (7) that communicates via a high-pressure connection (2), an electromagnet (29), a high-pressure reservoir (4), a nozzle needle (8) which is axially displaceable against a nozzle needle seat (12) in order to adjust an injection onset and an injection quantity in a common rail injection system of an internal combustion engine as a function of a position of a control piston (27) that is biased in one direction by a spring (28) and moved in the opposite direction by said electromagnet, the nozzle needle (8) is coupled via an intermediate piece (14) to a servo piston (20) that cooperates with the control piston (27)and in which a first throttle (30) is provided between the high-pressure connection (2) and a control chamber (31), a second throttle (34) is provided between the control chamber (31) and a pressureless chamber (21) in an interior of the servo piston (20), the area of the first throttle being less than the area of the second throttle (34). and a first control piston seat (25) and a second control piston seat (26), which are spaced apart from one another, are formed on the control piston (27) between the control chamber (31) and the pressureless chamber (21).

2. The common rail injector according to claim 1, in which a stop (33) for the servo piston (20) is provided in the injector housing (7).

3. The common rail injector according to claim 1, in which the servo piston (20) is positioned within a control chamber (31) and has an end face (32), which is positioned within the control chamber (31), and the end face (32) is larger than the face of the nozzle needle (8) which gets acted upon by high pressure fuel to open the injector.

4. The common rail injector according to claim 2, in which the servo piston (20) is positioned within a control chamber (31) and has an end face (32), which is positioned within the control chamber (31), and the end face (32) is larger than the face of the nozzle needle (8) which gets acted upon by high pressure fuel to open the injector.

5. A common rail injector (1) comprising an injector housing (7) that communicates via a high-pressure connection (2) to a high-pressure reservoir (4), a control piston (27), an electromagnet (29) which controls the position of the control piston, a nozzle needle (8) which is axially displaceable against a nozzle needle seat (12) in order to adjust an injection onset and an injection quantity as a function of a position of a control piston (27), the nozzle needle (8) being coupled to a servo piston (20) that cooperates with the control piston (27), and wherein a first throttle (30) is provided between the high-pressure connection (2) and a control chamber (31), a second throttle (34) is provided between the control chamber (31) and a pressureless chamber (21), the area of the first throttle being less than the area of the second throttle (34), and a first control piston seat (25) and a second control piston seat (26), which are spaced apart from one another, are formed on the control piston (27) between the control chamber (31) and the pressureless chamber (21).

* * * * *